US005382210A

United States Patent [19]

Rekers

[11] Patent Number: 5,382,210

[45] Date of Patent: Jan. 17, 1995

[54] DYNAMICALLY BALANCED ROWING SIMULATOR

[76] Inventor: Casper J. N. Rekers, Baalder Esch 8, NL-7772 JV Hardenberg, Netherlands

[21] Appl. No.: 976,166

[22] Filed: Nov. 13, 1992

[51] Int. Cl.[6] ..... A63B 69/06

[52] U.S. Cl. ..... 482/72; 482/125

[58] Field of Search ..... 482/72, 111, 125, 121, 482/51, 73, 129, 133

[56] References Cited

U.S. PATENT DOCUMENTS

| | | | |
|---|---|---|---|
| 567,915 | 9/1896 | McLarty | 482/72 |
| 2,183,345 | 12/1939 | Brandon | 482/72 |
| 4,396,188 | 8/1983 | Dreissigacker . | |
| 4,647,035 | 3/1987 | Yellen . | |
| 4,772,013 | 9/1988 | Tarlow, Jr. | 482/111 |
| 4,789,153 | 12/1988 | Brown | 482/111 |
| 4,798,378 | 1/1989 | Jones . | |

FOREIGN PATENT DOCUMENTS

| | | | |
|---|---|---|---|
| 0376403 | 7/1990 | European Pat. Off. | 482/72 |
| 0099125 | 5/1923 | Switzerland | 482/72 |
| 164228 | 12/1933 | Switzerland . | |

*Primary Examiner*—Stephen R. Crow
*Attorney, Agent, or Firm*—Weingarten, Schurgin, Gagnebin & Hayes

[57] ABSTRACT

A rowing simulator which provides an oarsman with realistic resistance, motion, and feel. A curved frame supports and guides a freely sliding seat and a freely sliding energy dissipation unit. An oarsman, positioned on the seat, places his or her feet on a footrest that is part of the energy dissipating unit and pulls on a handle that simulates an oar. A chain connected to the handle causes a geared, resistance-producing flywheel to spin and a take-up device, having a series of pulleys and an elastic element, controls chain tension. During exercise, the independent seat and energy dissipating unit move apart and then together in a coordinated manner as a function of the stroke cycle of the oarsman. The curvature of the frame allows gravity to keep the oarsman in a central portion of the frame.

12 Claims, 1 Drawing Sheet

DYNAMICALLY BALANCED ROWING SIMULATOR

FIELD OF THE INVENTION

The invention relates to the field of exercise equipment, and more particularly to an rowing machine which simulates the power distribution characteristics of rowed boats.

BACKGROUND OF THE INVENTION

Prior art rowing simulators, such as U.S. Pat. No. 4,396,188 to Dreissigacker et al., typically provide a frame with a slidable seat that simulates the seat in a boat, and a stationary frame having a braking system. A disadvantage of this type of simulator is that the power distribution characteristics differ considerably from the actual sensation of rowing in a real boat or shell. These rowing simulators, when used for training oarsmen, cause oarsman to develop improper coordination patterns, and increase the risk of knee, back, and shoulder injuries.

An improved rowing device is disclosed in European Patent Application 89203317.6 to Oosterhout et al., wherein a rowing exercise device is described that has an essentially horizontal stationary frame with two moving parts: a sliding seat and a movable energy dissipating unit with a footrest. The device uses a complicated mechanical system to balance the forces exerted by an oarsman on a drive chain and movable energy dissipating unit, to keep the movable energy dissipating unit and the seat in an acceptable position during operation of the device. A problem, however, is that the position of the movable energy dissipating unit, and hence that of the oarsman, is dependant on the weight of the oarsman, the stroke rate, and the internal friction and hysteresis in the elastic element. This necessitates frequent adjustment of the inclination of the stationary frame.

SUMMARY OF THE INVENTION

In surmounting the disadvantages of prior art rowing simulators, the invention provides a dynamically balanced rowing simulator having a simple and inexpensive means of stabilizing the position of a movable energy dissipating system and oarsman, independent of internal friction or hysteresis in an elastic element, thereby providing an excellent simulation of the power distribution characteristics experienced in rowing shells.

In a first embodiment, a dynamically balanced rowing simulator comprises a substantially horizontal frame, having an upward curvature on at least one end; and an energy dissipating unit engaged with the frame and movable there-along in a generally horizontal translation. The simulator is further provided with a flywheel, a braking means, a handle simulating an oar, a means for driving the flywheel connected to the handle, take-up means for the drive means, a foot rest, and a sliding seat engaged with the frame and movable there-along in a generally horizontal translation towards and away from the energy dissipating unit.

In a second embodiment, a rowing simulator comprises a frame upwardly curved on an end, that supports a movable seat and a movable energy dissipating unit that includes a flywheel, a handle, a chain, a take-up means, and a footrest. The flywheel resembles a bladed fan and is mounted on a shaft with gears and a one-way clutch. Pulling the chain with the handle causes the flywheel to turn. Chain slack is eliminated and tension is maintained by routing the chain through a series of pulleys in the take-up means. The take-up means is anchored to the energy dissipating unit with an elastic cord that is also routed through pulleys. A footrest is also attached to the energy dissipating unit.

BRIEF DESCRIPTION OF THE DRAWINGS

A more complete understanding of the present invention and the attendant advantages and features thereof will be more readily understood by reference to the following detailed description when considered in conjunction with the accompanying drawings wherein.

DETAILED DESCRIPTION OF THE DRAWING

Figure 1:
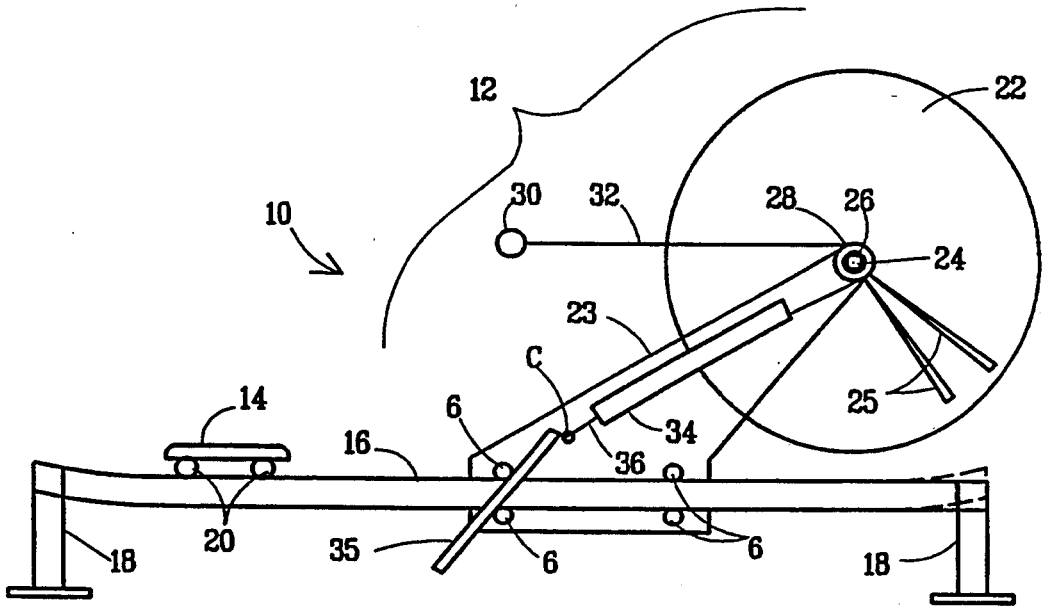
FIG. 1 is a side-elevational view of the dynamically balanced rowing simulator.

FIG. 1 illustrates a dynamically balanced rowing simulator 10 having an energy dissipating unit 12, a seat 14, and a monorail 16. The monorail 16 is supported by legs or a stand 18. The seat 14 and the energy dissipating unit 12 are independently mounted on the monorail 16 in a manner that permits them to freely slide on the monorail 16 along a generally horizontal axis. In the illustrated embodiment, rollers 20 facilitate the axial movement of the seat 14 and energy dissipating unit 12, however, any type of slidable mounting such as ball bearings or a lubricated track is also acceptable, as is a multi-rail track.

In order to realistically simulate rowing a boat, both the level of friction, as well as the inertial behavior of the rowing simulator 10 should approximate that encountered in rowing a real boat through water. Therefore, the mass of the energy dissipating unit 12 and the resistive load are adjusted to levels equivalent to those of the specific type of boat an oarsman is training for. To create the appropriate resistive load, as well as a smooth, natural action or rowing feel, a fanned flywheel 22 is mounted on the frame 23 of the energy dissipating unit 12. The flywheel 22 incorporates blades 25 or fins that are exposed to the ambient air. Blade size, shape, and orientation, together with the speed and mass of the flywheel 22 create a resistive load similar to that of an oar moving through water. The flywheel 22 is rotatably mounted on a flywheel shaft 24 that has a one-way clutch 26 to prevent counter-rotation of the flywheel 22. Reduction gears 28 may also be provided on the flywheel shaft 24 to vary the resistive load. Accordingly, adjustment of the resistive load is accomplished by selecting an appropriately sized reduction gear 28 and/or by adjusting the airflow to the blades 25 of the flywheel 22 by appropriate means, such as adjustable louvers.

The energy dissipating unit 12 also incorporates a handle 30 that simulates an oar handle. In a present embodiment, the handle 30 is connected to a bicycle type chain 32 that passes over the reduction gears 28 and into a chain take-up device 34, further described with respect to FIG. 2. A cable, belt or rope, however, may be substituted for the chain 32 and guided differently, such as in a groove or track; and other means, such as friction devices, may be provided to alter the resistive load. A one or two-piece footrest 35 is attached to the frame 23 of the base of the energy dissipating unit 12 at its base, in an appropriate position to simulate a similar structure in a row boat or racing shell.

The mass of the energy dissipating unit 12 is preferably equivalent to the mass of the specific boat, including the coxswain divided by the number of oarsmen. An oarsman training for a single scull might therefore use a rowing simulator 10 with an energy dissipating unit 12 having a mass of 14 kgs, corresponding to the mass of a single sculling boat, whereas an oarsman training for a coxed pair, which has a total mass including the coxswain of approximately 80 kgs, and therefore 40 kgs per oarsman, would use an energy dissipating unit with a mass of 40 kgs to obtain a realistic simulation. Mass may be temporarily altered by attaching weighted plates to the frame 23 of the energy dissipating unit 12, or by any other means well known in the art.

Figure 2:
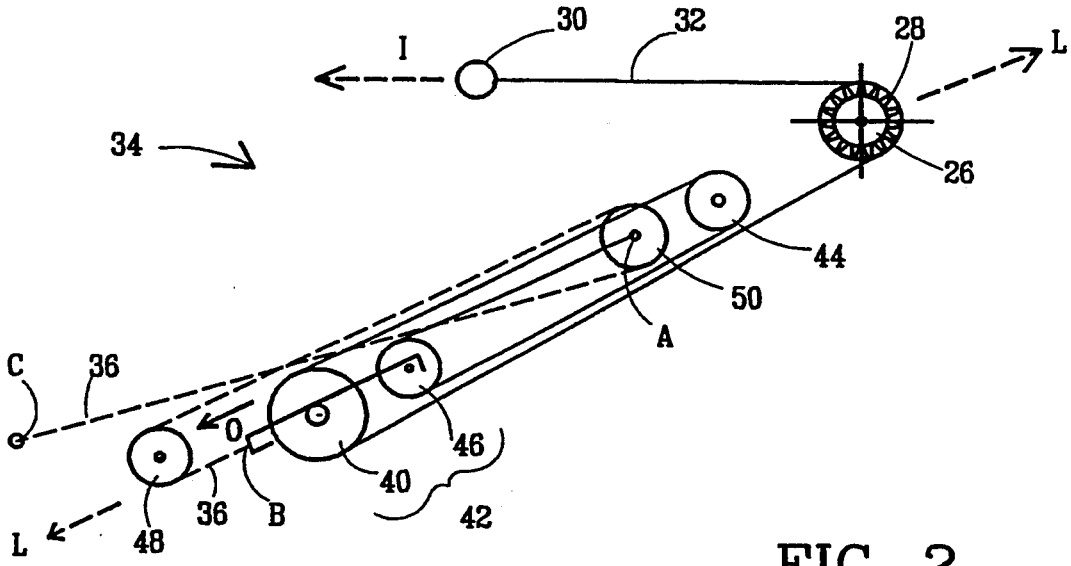
FIG. 2 is a side sectional view of a chain take-up means of the invention as depicted in FIG. 1.

FIG. 2 is a side sectional view of the chain take-up device 34, that illustrates the relationship and function of the components of the take-up device 34. The take-up device 34 is structured so that a chain 32, long enough to permit a normal stroke length of 1.6 meters, may be contained in a relatively small compartment by winding it back and forth around a series of pulleys. In the exemplary embodiment, the take-up device 34 uses an elastic cord 36 to smoothly compensate for irregularities in tension applied to the chain 32. Alternatively, a constant tension spring may be used.

In an exemplary take-up device 34, the chain 32 having been looped around the reduction gears 28 which house the one-way clutch assembly 26, loops around a first pulley 40 of a movable pulley assembly 42. Increasing tension on the chain 32, by pulling the handle away from the flywheel 22 (arrow I), moves the movable pulley assembly 42 away from a static position along a controlled axis of movement (L L'). The chain then loops around a first fixed pulley 44 attached to the frame of the movable energy dissipating unit 12, and then around a second pulley 46 of the movable pulley assembly 42. The chain 32 is anchored to the frame 13 of the energy dissipating unit 12 at point A.

An elastic cord 36 is anchored to the movable pulley assembly 42 at point B, then looped around a second fixed pulley 48 and a third fixed pulley 50 to bias the movable pulley assembly 42 in a direction opposite (arrow 0) chain tension. The elastic cord 36 is anchored to the frame of the energy dissipating unit 12 at point C. An alternative to the pulley arrangement is a constant tension spring element.

In the exemplary embodiment, the pulleys serve to guide and thus neatly wind considerable lengths of chain 32 and elastic cord 36 in a compact unit. Therefore, because the pulleys are not used primarily for mechanical advantage, other guide means such as tracks, grooves or loops may be used to permit smooth movement of the drive means and to prevent entanglement during rewinding. Accordingly, the diameter of pulleys 48 and 50 is determined by the minimum permissible radius of curvature of the elastic cord 36 under tension in relation to the wear and the service life thereby obtainable. The diameter of the smallest chain pulley, the fixed first pulley 44, is determined by the minimum permissible radius of curvature for a smooth running of the chain 32. The diameter of the large chain pulley, the first pulley 40, is such that the outer loop of the chain runs clear of the inner loop of the chain as depicted in FIG. 2.

The advantages of the rowing simulator 10 are better understood by describing its operation. A rower sits on the movable seat 14, places his or her feet onto the footrest 35, grasps the handle 30 and begins to row. Each stroke entails both arm and leg movement. When the rower pushes against the footrest 35 with the feet, the seat 14 and the rower move away from the energy dissipating unit 12. Then, when the rower pulls the handle 30, the chain 32 moves. Because the chain 32 is engaged with the reduction gears 28, the pulling force of the rower is transferred to the flywheel 22 which accelerates as the force is increased. During the recovery, when the rower stops pulling, the chain 32 is retracted into the take-up device 34 by the force of the elastic cord 36, and the seat 14 and energy dissipating unit 12 move towards each other while the rower prepares for a new stroke. During each stroke and recovery, the relative movement of the rower and seat 14, and the energy dissipating unit 12 are inversely proportional to the relative mass of the rower and the mass of the energy dissipating unit 12. This very closely approximates the situation in a real rowing shell, in which the rowing shell traveling through water is the energy dissipating unit.

During exercise, both the seat 14 and the energy dissipating unit 12 move along the monorail 16. However, in order to maintain a natural rowing sensation and a stable dynamic situation, where the stabilizing forces on the rower and boat simulator are equal and opposed over the entire stroke and recovery cycle, neither the seat 14 nor the energy dissipating unit 12 may touch a stop, bumper or spring at the end of the monorail 16. Instead, stabilization of the rowing dynamics is achieved with gravity.

In the illustrated embodiment, the monorail 16 has a horizontal central portion and an upwardly curved end portion on the seat side of the monorail 16, so that both ends of the monorail 16 are at the same elevation, and that the lowest point of the monorail is at the preferred seat position. If during exercise, the rower approaches the end of the monorail 16 and starts to move up the curved end, the force of gravity causes the seated rower to slide or roll gently back toward the lowest point. The monorail 16 may also be curved on both ends so that the resulting low point on the monorail 16 fixes the position of the common center of gravity of the rower and the energy dissipating unit 12, which prevents both the seat 14 and the energy dissipating unit 12 from touching the extremes of the monorail 16. The curved monorail 16 is unique in that the stabilizing forces on the rower and the energy dissipating unit 12 are equal and opposed over the entire stroke and recovery cycle. The resulting equilibrium created by the simulator 10 gives a rower a natural rowing feel.

A variety of modifications and variations of the present invention are possible in light of the above teachings. It is therefore to be understood that, within the scope of the appended claims, the present invention may be practiced otherwise than as specifically described hereinabove.

I claim:

1. A dynamically balanced rowing simulator comprising:

a beam, having a substantially horizontal central portion and at least one upwardly curving end portion;

a seat, engaged with said beam and movable there-along in a generally horizontal translation; and an energy dissipating unit, engaged with said beam and freely movable there-along in a generally horizontal translation independently from said seat, said energy dissipating unit comprising:

a frame for supporting a flywheel, said flywheel rotatably mounted on a flywheel shaft;

a handle;

a drive means, connected to said handle, for converting a translation of said handle into a rotation of said flywheel;

a take-up means, attached to said frame, said take-up means rewinding and maintaining a predetermined tension on said drive means, said take-up means comprising one of a constant tension spring element or an elastic cord and a plurality of pulleys; and a footrest, attached to said frame.

2. The rowing simulator of claim 1, wherein said beam comprises a monorail mounted on support means.

3. The rowing simulator of claim 1, wherein said at least one upwardly curving end portion allows gravitational force to cause said seat and said energy dissipating unit to tend to move toward said substantially horizontal central portion when displaced therefrom.

4. The rowing simulator of claim 1, wherein said energy dissipating unit has a weight of approximately 14 kilograms.

5. The rowing simulator of claim 1, wherein said energy dissipating unit has a weight of approximately 40 kilograms.

6. The rowing simulator of claim 1, wherein said flywheel shaft comprises a one-way clutch and gear.

7. The rowing simulator of claim 1, wherein said drive means is a chain.

8. The rowing simulator or claim 1, wherein said drive means is a cable.

9. The rowing simulator of claim 1, wherein said drive means is a rope.

10. The rowing simulator of claim 1, wherein said drive means is a belt.

11. A dynamically balanced rowing simulator comprising:

a beam, having a substantially horizontal central portion and an upwardly curving end portion;

a seat, engaged with said beam and movable there-along in a generally horizontal translation; and an energy dissipating unit, engaged with said beam and freely movable there-along in a generally horizontal translation comprising:

a frame, for supporting a flywheel, said flywheel comprising a bladed fan rotatably mounted on a flywheel shaft having a one-way clutch and gear;

a handle;

a chain, connected to said handle and engaged with said gear of said flywheel, for converting a translation of said handle into a rotation of said flywheel by means of said one-way clutch and of said gear, said chain threaded through a take-up means that comprises:

a pulley assembly, movable along a longitudinal axis about a neutral point in a first and a second direction, wherein tension applied to said chain moves said pulley assembly in said first direction, and tension from said elastic cord biases said pulley in said second direction opposite said first direction;

a first pulley, anchored to said movable pulley assembly, for receiving said chain from said flywheel, said elastic cord anchored to said pulley assembly by said second end of said elastic cord;

a second pulley, anchored to said frame, for receiving said chain from said first pulley;

a third pulley, anchored to said movable pulley assembly for receiving said chain from said second pulley;

a chain anchor point, for attaching said chain to said take-up means;

a fourth pulley, anchored to said frame, for receiving said elastic cord from said pulley assembly;

and a fifth pulley for receiving said elastic cord from said fourth pulley; and a footrest, attached to said frame; and wherein said upwardly curving end portion allows gravitational force to cause said seat and said energy dissipating unit to tend to move toward said substantially horizontal central portion when displaced therefrom.

12. A dynamically balanced rowing simulator comprising:

a beam, having a substantially horizontal central portion, a first upwardly curving end portion, and a second upwardly curving end portion;

a seat, engaged with said beam and movable there-along in a generally horizontal translation; and an energy dissipating unit, engaged with said beam and movable there-along in a generally horizontal translation comprising:

a frame, for supporting a flywheel, said flywheel comprising a bladed fan rotatably mounted on a flywheel shaft having a one-way clutch and gears;

a handle;

a chain, connected to said handle and engaged with said gears of said flywheel, for converting a translation of said handle into a rotation of said flywheel by means of said one-way clutch and of said gears;

a take-up means, beyond said gearing means and connected to said frame, for rewinding and maintaining a predetermined tension on said chain; said take-up means comprising:

an elastic cord, having a first end and a second end, anchored to said frame by said first end;

a pulley assembly, movable along a longitudinal axis about a neutral point in a first and second direction, wherein tension applied to said chain moves said pulley assembly in said first direction, and tension from said elastic cord biases said pulley in said second direction opposite said first direction, said elastic cord attached to said pulley assembly by said second end of said elastic cord;

a first pulley, anchored to said movable pulley assembly, for receiving said chain from said flywheel;

a second pulley, anchored to said frame, for receiving said chain from said first pulley;

a third pulley, anchored to said movable pulley assembly for receiving said chain from said second pulley;

a chain anchor point, for attaching said chain to said take-up means;

a fourth pulley, anchored to said frame, for receiving said elastic cord from said pulley assembly; and a fifth pulley for receiving said elastic cord from said fourth pulley;

a footrest, attached to said frame; and wherein said first and said second upwardly curving end portions allow gravitational force to cause said seat and said energy dissipating unit to tend to move toward said substantially horizontal central portion when displaced therefrom.

* * * * *

UNITED STATES PATENT AND TRADEMARK OFFICE

CERTIFICATE OF CORRECTION

PATENT NO. : 5,382,210
DATED : Jan. 17, 1995
INVENTOR(S) : Casper J.N. Rekers

It is certified that error appears in the above-indentified patent and that said Letters Patent is hereby corrected as shown below:

Column 5, line 40, the following claim should be inserted:

--11. The rowing simulator of claim 1, wherein said flywheel comprises a bladed fan.--

Column 5, line 40, "11. A dynamically balanced" should read --12. A dynamically balanced--.

Column 6, line 21, "12. A dynamically balanced" should read --13. A dynamically balanced--.

Signed and Sealed this

Third Day of October, 1995

Bruce Lehman

*Attest:*

BRUCE LEHMAN

*Attesting Officer*

*Commissioner of Patents and Trademarks*